US008262873B2

(12) United States Patent
Wurm et al.

(10) Patent No.: US 8,262,873 B2
(45) Date of Patent: Sep. 11, 2012

(54) ANODE ASSEMBLY FOR ELECTROPLATING

(75) Inventors: Jörg Wurm, Kronberg (DE); Stephane Menard, Lyons (FR); Lothar Schneider, Wächtersbach (DE)

(73) Assignees: Metakem Gesellschaft fur Schichtchemie der Metalle mbH, Usinen (DE); M. P. C. Micropulse Plating Concepts, Lyons (FR)

( * ) Notice: Subject to any disclaimer, the term of this patent is extended or adjusted under 35 U.S.C. 154(b) by 169 days.

(21) Appl. No.: 12/665,687

(22) PCT Filed: Jun. 20, 2008

(86) PCT No.: PCT/EP2008/057856

§ 371 (c)(1),
(2), (4) Date: Apr. 20, 2010

(87) PCT Pub. No.: WO2008/155408

PCT Pub. Date: Dec. 24, 2008

(65) Prior Publication Data

US 2010/0206735 A1 Aug. 19, 2010

(30) Foreign Application Priority Data

Jun. 20, 2007 (EP) ..... 07012062

(51) Int. Cl.
*C25B 11/03* (2006.01)
*C25C 7/02* (2006.01)

(52) U.S. Cl. ..... 204/285; 204/284; 204/259; 204/213

(58) Field of Classification Search ..... 204/284, 204/285, 259, 213
See application file for complete search history.

(56) References Cited

U.S. PATENT DOCUMENTS

| | | | | |
|---|---|---|---|---|
| 5,938,899 | A * | 8/1999 | Forand | 204/259 |
| 6,156,169 | A | 12/2000 | Yang et al. | |
| 2005/0184369 | A1 | 8/2005 | Sonoda et al. | |
| 2006/0124454 | A1 * | 6/2006 | Wurm et al. | 204/286.1 |
| 2006/0272951 | A1 * | 12/2006 | Schmergel et al. | 205/291 |

FOREIGN PATENT DOCUMENTS

| | | | |
|---|---|---|---|
| CN | 2389902 | Y | 8/2000 |
| GB | 991634 | A1 | 5/1965 |
| WO | 2004059045 | A2 | 7/2004 |

* cited by examiner

*Primary Examiner* — Bruce Bell
(74) *Attorney, Agent, or Firm* — McGlinchey Stafford PLLC; R. Andrew Patty, II

(57) ABSTRACT

The invention relates to an anode assembly for electroplating comprising (a) an anode body comprising soluble anode material and (b) a shielding covering at least part of the anode body and comprising a self-passivating metal electrically connected to the anode body and allowing electrolyte transport therethrough. The shielding comprises at least one layer of self-passivating metal having no openings larger than 2 mm, preferably 1 mm, in width or the shielding comprises at least two layers of self-passivating metal wherein the openings of at least one layer are at least partially covered by the metal of another layer. The invention also relates to a shielded anode basket, a method for electroplating and the use of the anode assembly and the shielded anode basket.

37 Claims, No Drawings

ANODE ASSEMBLY FOR ELECTROPLATING

REFERENCE TO RELATED APPLICATIONS

This is the National Stage of International Patent Application PCT/EP2008/057856, filed on Jun. 20, 2008, which application claims priority from European Application No. 07012062.1, filed Jun. 20, 2007.

The present invention relates to an anode assembly for electroplating.

Some electroplating processes, such as those involving precious metals, for instance gold or platinum, are generally conducted using metal baths and insoluble anodes. Most electroplating baths also include additives used to improve homogeneity, hardness, gloss and other characteristics of the plating layers deposited at the cathode. These additives are typically organic substances.

In electroplating processes using insoluble anodes, oxygen and/or chlorine will be developed at the anode. However, insoluble anodes typically have a high overpotential for oxygen development. Due to the resulting high anodic potential, organic additives can be oxidized at the anode before or together with oxygen and/or chlorine production. WO 2004/059045 A2 discloses an insoluble anode wherein oxidation of additives is reduced by means of a shielding.

In contrast to this, many other electroplating processes, such as copper-plating, nickel-plating, tin-plating and the like, mostly use soluble anodes. These soluble anodes are typically either in the form of sheets, bars or the like made of the respective metal which hang down from copper bars, or in the form of small metal pieces held in e.g. titanium or zirconium anode baskets. These anode baskets have been used for decades as containers for holding soluble anode material.

Copper and nickel baths are inter alia used for depositing thicker coatings and for electroforming purposes. Copper coatings are mostly used in scientific installations such as particle accelerators and wind tunnels. Electroformed nickel foils are used for electric shavers etc.

As in the case of insoluble anodes, most electroplating baths using soluble anodes likewise include additives. However, soluble anodes normally only have a low overpotential for metal dissolution. Thus, problems associated with oxidation of organic additives have not been expected nor have such problems previously been reported for soluble anodes.

Surprisingly, it has now been observed that a substantial amount of additives is consumed by anodic oxidation at soluble anodes. Oxidized additives must be replaced in order to achieve desirable coating characteristics. Furthermore, breakdown products resulting from anodic oxidation of additives interfere with the plating process.

Thus, a need has now been realized for a soluble anode for electroplating which is capable of reducing additive consumption at the anode when used in an electroplating bath containing additives. Such reduced additive consumption would in turn reduce the need for bath regeneration and the disposal of waste in rinsing waters. Moreover, there is a need for a soluble anode for electroplating which is capable of producing metal coatings of high purity with little inclusion of additive and break-down products to reduce internal stresses.

These problems are surprisingly solved by the anode assembly according to claims 1 to 23. The invention also relates to the shielded anode basket according to claims 24 to 34, the method according to claim 35 and the use according to claim 36.

The anode assembly according to the invention comprises a) an anode body comprising soluble anode material and b) a shielding covering at least part of the anode body and comprising a self-passivating metal electrically connected to the anode body and allowing electrolyte transport therethrough, wherein:

(i) the shielding comprises at least one layer of self-passivating metal having no openings larger than 2 mm in width, preferably having no openings larger than 1 mm in width, or (ii) the shielding comprises at least two layers of self-passivating metal wherein the openings of at least one layer are at least partially covered by the metal of another layer.

The term "soluble anode material" as used herein refers to an anode material that will be dissolved upon anodic oxidation in an electrochemical process. Solubility properties of anode material may depend on the type of electrolyte used in a particular electrochemical process. For example, some materials such as stainless steel, nickel or nickel-plated steel are anodically soluble in acidic electrolytes and insoluble in alkaline electrolytes. Other materials such as zinc are generally soluble in both acidic and alkaline electrolytes. Therefore, the term "soluble anode material" is to be understood herein as encompassing all materials that will be dissolved upon anodic oxidation in an electrochemical process applying any electrolyte typically used in the field of electroplating. Typically, the soluble anode material will comprise at least one metal to be deposited in an electroplating process. Preferred soluble anode materials for use in the present invention are zinc, silver, tin, copper, nickel, cadmium, iron, cobalt, mixtures and alloys thereof.

The term "soluble anode" as used herein refers to an anode comprising a soluble anode material as defined above.

The term "self-passivating metal" as used herein refers to a conductive metal that is electrochemically inactive when anodically polarized under electroplating conditions. Examples of self-passivating metals include titanium, zirconium, niobium, mixtures and alloys thereof.

The term "insoluble active material" as used herein refers to a material, preferably a metal and/or metal oxide, that is not electrochemically dissolved and remains electrochemically active when anodically polarized under electroplating conditions. Examples of insoluble active materials include platinum, iridium and other platinum metals, mixtures and alloys thereof and the respective oxides. Furthermore, the term also encompasses metals such as nickel that are not electrochemically dissolved and remain electrochemically active when anodically polarized in alkaline electrolytes.

The term "activated corrosion-resistant metal" as used herein refers to a self-passivating metal having an active layer of insoluble active material.

The term "width" as used herein with respect to an opening is the smallest distance that can be found between two opposite parallel lines tangent to the boundary of the opening.

It has been surprisingly found that the shielded soluble anode assembly according to the present invention allows for a substantial reduction of anodic consumption of additives.

It is contemplated that the shielding of the anode assembly provides for both a mechanical barrier to the transport of electrolyte as well as an potential barrier for the transport of positively charged ions to the soluble anode material. Thus, a calm zone is created with reduced electrolyte exchange and deflection or even repulsion of positively charged ions.

A further advantage of the soluble anode assembly according to the present invention is a more regular and homogenous dissolution of the soluble anode material in comparison to conventional soluble anodes. Break-off of particles from the soluble anode material resulting from irregular dissolution is reduced, and less of the soluble anode material is lost to the electroplating process. It is contemplated that the shielding may also work like a Faraday cage. Thus, a more homogeneous electrical field around the anode body may be obtained and voltage peaks may be substantially reduced.

The present invention also provides for a reduced loss of soluble anode material due to formation of higher oxides. Some metals used as soluble anodic material do not go directly into solution upon anodic oxidation. Instead, they first form an oxide which then dissolves, often aided by a very low concentration of chloride ions. Anodic oxidation of the metal can however also lead to higher oxides. For instance, in the case of soluble tin anodes, dissolution of tin can proceed via $Sn^{2+}$ formation, while at other places in the tin package tin may simultaneously be oxidized to $Sn^{4+}$ and may then further form $SnO_2$. $SnO_2$ is insoluble, and thus the tin that is oxidized to form $SnO_2$ is lost for the electroplating process. There may be tin losses of 20% by weight and more when conventional soluble anodes are used. Surprisingly, using the soluble anode according to the present invention such loss of soluble anode material is substantially reduced.

Furthermore, the present invention also allows for a more constant voltage throughout the electroplating process. Particularly in applications using conventional anode baskets for holding pieces of soluble anode material such as tin, it is often observed that starting from a newly filled basket a substantial increase in voltage occurs during the electroplating process. This increase in voltage leads to higher electrode potentials and thus gives rise to several undesired side-reactions within the electroplating process, such as increased oxidation of additives or formation of higher metal oxides, e.g. $SnO_2$ in the case of tin. In contrast to this, the anode assemblies according to the present invention display a markedly reduced voltage increase throughout the electroplating process.

The shielding according to the present invention comprises a self-passivating metal. Generally, the self-passivating metal may be any metal that is self-passivating under the specific electroplating conditions to be used. Preferably, the self-passivating metal is selected from the group consisting of titanium, zirconium, niobium, mixtures and alloys thereof. It is further preferred that the self-passivating metal is electrochemically oxidized on its surface.

The self-passivating metal may take any one of a variety of different forms. It is preferred that the self-passivating metal is in the form of a net, mesh, grit, tissue or perforated sheet.

In one preferred embodiment, at least one layer of self-passivating metal has no openings larger than 0.5 mm, preferably no openings larger than 0.3 mm, more preferably no openings larger than 0.2 mm, most preferably no openings larger than 0.1 mm in width.

In another preferred embodiment, at least two layers of self-passivating metal have no openings larger than 10 mm, preferably no openings larger than 6 mm, more preferably no openings larger than 3 mm, most preferably no openings larger than 1 mm in width.

In another preferred embodiment, at least three layers of self-passivating metal have no openings larger than 20 mm, preferably no openings larger than 10 mm, more preferably no openings larger than 5 mm, most preferably no openings larger than 2 mm in width.

In yet another preferred embodiment, at least four layers of self-passivating metal have no openings larger than 30 mm, preferably no openings larger than 15 mm, more preferably no openings larger than 8 mm, most preferably no openings larger than 3 mm in width.

The shielding may be mounted directly onto the anode body or may be mounted to the anode body at a distance. Alternatively, the shielding may be arranged at a distance from the anode body without being mounted thereto. For example, the shielding may be arranged between the anode body and the cathode of an electroplating apparatus by hanging down from copper rails of the electroplating apparatus.

The self-passivating metal of the shielding is electrically connected to the anode body so that the shielding and the anode body are in electrical contact. Particularly, the shielding may be directly or indirectly connected to any means of current supply to the anode body. For example, where the anode body and the shielding both hang down from copper rails of an electroplating apparatus, the electrical connection of the self-passivating metal of the shielding to the anode body can be realized via the copper rails.

Where the shielding comprises more than one layer, the layers can be mounted directly one on top of the other. Alternatively, the layers can be mounted such that adjacent layers are separated by a certain distance, for example by a distance in the range of 0.5 mm to 2 mm.

Where the shielding comprises at least two layers, the layers are in a "staggered arrangement" in that the openings of one layer are at least partially covered by the metal of another layer. It is preferred that the openings of any one layer are at least partially covered by the metal of another layer, more preferably by the metal of an adjacent layer.

In a particularly preferred embodiment, the shielding comprises two or more layers of self-passivating metal in a staggered arrangement such that an observer looking orthogonally onto the shielding would not be able to see through the shielding although transport of electrolyte therethrough is possible due to a distance separating the layers. Such an embodiment is particularly preferred.

The shielding may generally have any suitable thickness. It is preferred that the shielding has a total thickness of at least 1 mm, more preferably at least 2 mm, most preferably at least 4 mm.

Besides the self-passivating metal, other materials can be included in the shielding. For example, the shielding can comprise one or more layers of one or more non-metal materials. The non-metal materials may partly contribute to the shielding effect by providing a further mechanical barrier to electrolyte transport. However, as it is contemplated that combined mechanical and potential barrier effects of the self-passivating metal electrically connected to the anode body are particularly advantageous, non-metal materials are not considered in determining the dimensions of openings in the layers of self-passivating metal as defined above. In one preferred embodiment, the shielding comprises at least one layer of a non-metal material, such as a non-metal web material. The non-metal material can also be a membrane.

The shielding may cover all or part of the portion of the anode body that is to be immersed in an electroplating bath. Preferably, the shielding covers all side and bottom portions of the anode body. From the viewpoint of economic efficiency, it is preferred that only the side portions of the anode facing or at least partially facing the cathode are covered by the shielding of the invention as it is believed that the contribution of the shielding on the other sides which do not face the cathode is negligible.

The shielding according to the invention can be used in different embodiments with different types of anode bodies.

According to one embodiment, the anode body is in the form of sheets, bars, plates, tubes, rods or other compact forms consisting, for instance, of tin, zinc, copper or nickel. The electrical connection of such anode bodies can be realized, for example, by hanging down from copper rails of an electroplating apparatus. Sheet anodes are for instance widely used in processes for tinning of steel strips.

The anode assembly according to the invention can comprise a plurality of anode bodies arranged in a straight, curved or circular row and at least one shielding covering the side of the anode bodies facing the cathode, wherein the shielding covers one or more or even all anode bodies. The shielding can also cover the side of the anode bodies which is turned away from the cathode. Therefore, in case of a row of plate or rod anodes, the shielding can be a mesh structure which is mounted via a stiffening frame in front and behind the row of anodes in a short distance to them. In particular, the shielding is mounted on the side facing the cathode. Preferably, the anodes have a shared shielding and it is not necessary to shield each anode separately.

In another embodiment, the anode assembly comprises an anode basket. As used herein, the term "anode basket" refers to a perforated shallow receptacle or container for holding particles of soluble anode material to be submerged in a plating bath. Typically, the anode basket comprises sidewalls, a bottom wall and an open upper end wherein at least one of the sidewalls is perforated to allow electrolyte transport therethrough. The pieces of soluble anode material can be provided for instance in the form of balls, pellets or wire cuttings of the anode material.

In another embodiment, the anode basket is a mesh tube.

The anode basket can comprise a self-passivating metal. Generally, the self-passivating metal may be any one of the metals contemplated as self-passivating metal of the shielding. It is preferred that the self-passivating metal of the anode basket is selected from the group consisting of titanium, zirconium, niobium, mixtures and alloys thereof.

The anode basket can also comprise a plastic material. Plastic materials suitable for use in anode baskets according to the invention are known in the art.

Where the material of the anode basket is electrically conductive, the electrical contact of the anode body can be via the anode basket.

For improving the electrical contact of the soluble anode material to the anode basket, an insoluble active material or an activated corrosion-resistant metal can be welded to the inside of a metallic anode basket. This material is preferably arranged such that it is covered by the self-passivating metal of the anode basket in order not to be exposed to the electric field lines from the cathode.

Furthermore, a self-passivating metal, an insoluble active material or an activated corrosion-resistant metal, such as an activated titanium or zirconium rod or strip, can be inserted among the pieces of soluble anode material to provide the electrical contact of the anode body. This type of contact is typically used to provide the current supply to soluble anode material in plastic anode baskets. Using an insoluble active material or an activated corrosion-resistant metal is preferred because it prevents passivation caused by high current transfer resulting in reduced contact performance.

In a particularly preferred embodiment, the anode basket itself can comprise the shielding according to the invention. Particularly, the shielding may form at least part of the anode basket. More particularly, the shielding may form those walls or portions of the anode basket that allow electrolyte transport therethrough. Alternatively, the shielding may cover all or part of the anode basket. Particularly, the shielding may cover only those portions of the anode basket that allow electrolyte transport therethrough.

In the embodiments discussed immediately above, a shielded anode basket is employed. The invention thus also relates to a shielded anode basket comprising a shielding according to the invention.

The shielded anode basket comprises a) an anode basket for holding particles of soluble anode material and b) a shielding comprising a self-passivating metal and allowing electrolyte transport therethrough, wherein:

(i) the shielding comprises at least one layer of self-passivating metal having no openings larger than 2 mm in width, preferably having no openings larger than 1 mm in width, or (ii) the shielding comprises at least two layers of self-passivating metal wherein the openings of at least one layer are at least partially covered by the metal of another layer.

Preferably, the anode basket comprises sidewalls, a bottom wall and an open upper end wherein at least one of the sidewalls is perforated to allow electrolyte transport therethrough. Typically, in an electroplating process the shielding will be electrically connected to the soluble anode material by any of the means discussed above.

As described above, the shielding may form at least part of the anode basket. Particularly, the shielding may form those walls or portions of the anode basket that allow electrolyte transport therethrough. Alternatively, the shielding may cover all or part of the anode basket. Particularly, the shielding may cover only those portions of the anode basket that allow electrolyte transport therethrough.

Other preferred embodiments of the shielded anode basket are as defined above for the shielding and the anode basket of the anode assembly.

For example, the anode basket may mostly consist of perforated and/or non-perforated self-passivating metal such as titanium wherein at least one sidewall of the anode basket is formed by the shielding. Likewise, the anode basket may mostly or in part consist of a plastic material provided with electrical contacts for the soluble anode material as discussed above wherein at least one sidewall of the anode basket allows for electrolyte transport therethrough and is either formed or covered by the shielding. When applied in an electroplating process, the shielded anode basket will be arranged such that the sidewall facing the cathode is a sidewall formed or covered by the shielding.

In one embodiment, the shielded anode basket according to the invention comprises a shielding which is fixed at the upper and lower part of the anode basket. For example, the shielding can be fixed to a basket, even when it is filled with anode pieces and without emptying it, by attaching the shielding structure at the upper rim of the basket and attaching the shielding at the lower end of the basket by e.g. using fixing means such as fasteners made of wire clicking into the mesh of the basket. For long baskets additional fasteners can be used in between.

During copper plating of printed circuit boards it has been observed that break-down products influence the deposition in a via to a greater extent than the deposition on the surface of the printed circuit board. Compared to insoluble anodes the influence of break-down products from soluble anodes is much larger. When filling the vias of printed circuit boards it is usually difficult to get rid of momentarily produced break-down products in the via. Locally, the throwing power is reduced resulting in a bad filling. In order to improve via filling, a high electrolyte exchange between anode and cathode appears to be needed. With the shielded anodes according to the invention less break-down products are produced and the electrolyte exchange appears to be less critical. Thus, the anode assembly and the anode basket according to the present invention can particularly be used for filling printed circuit boards and in particular for via filling of printed circuit boards.

Furthermore, the anode assembly and the anode basket according to the invention can particularly be used for electroplating, wherein an electrolyte comprising a relatively high amount of chlorides such as Watt's nickel or Wood's nickel baths is employed. The use of the shielded soluble anodes results in the formation of less chlorinated organics and an increased time interval for bath regeneration. Thus, also the amount of chlorinated compounds in the rinsing bath, which have to be disposed, is reduced.

It has been surprisingly found that shielded soluble anode assemblies and shielded anode baskets according to the invention provide for an improved electroplating process in comparison with existing anode baskets made of a self-passivating metal. In contrast to the existing anode baskets which only serve as containers for holding soluble anode material, the shielding of the anode assemblies and the anode baskets according to the invention also takes over an electrochemical function improving the electroplating performance.

The invention further relates to a method of electroplating comprising using an anode assembly or an anode basket as described above.

A further aspect of the invention is the use of an anode assembly or an anode basket as described above for electroplating.

The invention will be further illustrated with reference to the following examples.

EXAMPLE 1

Two copper plating installations for plating printed circuit boards were each equipped with 32 titanium baskets. Each of the baskets was 200×600 mm in size and consisted of a titanium mesh having a mesh size of 10×5×1×1 mm, i.e. an opening width of about 3 mm.

In one of the installations, a shielding was mounted to the mesh windows. The shielding was a staggered double layer shielding of oxidized titanium mesh having a mesh size of 4×2×0.5×0.5 mm, i.e. an opening width of about 1 mm, on the front of the basket and a single layer shielding of the same titanium mesh on the rear of the basket facing the bath wall.

The baskets were filled with small copper pieces and operated in a standard plating bath for printed circuit plating (30 g/l $Cu^{2+}$ as $CuSO_4$, 200 g/l $H_2SO_4$, 100 mg/l $Cl^-$, 40° C., 4 A/dm$^2$ in respect of the cathode surface). Additive consumption in each of the installations was monitored over an operation time of 10 weeks. In the installation applying the shielding, additive consumption was found to be reduced by 35% in comparison to the non-shielded installation.

EXAMPLE 2

A titanium mesh anode basket having a mesh size of 10×5×1×1 mm, i.e. an opening width of about 3 mm, was filled with small tin pieces and used in a sulfurous tin plating bath. As the plating process proceeded, the voltage slowly rose by about 10 V. The same basket was then equipped on all walls (side and bottom) with a shielding consisting of 2 layers of oxidized titanium mesh having a mesh size of 4×2×0.5×0.5 mm, i.e. an opening width of about 1 mm. The basket was newly filled with small tin pieces and used in the same sulfurous tin plating bath as above. With the shielded anode basket, the voltage rose only by about 3 V and then the process could be run at a constant voltage. Furthermore, additine consumption was decreased by more than 50% and tin consumption was reduced by nearly 20% relative to the anode basket without shielding.

Without wishing to be bound to a particular theory it is believed that due to the shielding according to the invention the formation of $Sn^{4+}$ is reduced which in turn results in a reduced contact resistance between the tin particles (one with another) and between the tin particles and the titanium basket. Due to this reduced contact resistance the formation of sparks is reduced which in turn increases the life of titanium baskets in tin applications. Thereby, zirconium baskets, which are frequently used because of the low life time of titanium baskets, could be replaced by shielded titanium baskets which would provide a remarkable cost benefit.

EXAMPLE 3

In an acid copper bath operated with soluble copper anodes in cylindric baskets having a diameter of 65 mm and a length of 700 mm, printed circuit boards were filled using unshielded baskets. Afterwards, a shielding comprising a titanium shielding of about 4×2×0.5×0.5 mm and a polypropylene shielding of about 4×2.5×0.8×0.8 mm was applied to each basket and again the same plating action was performed. The comparison of both plating results showed that due to an improved throwing power a much better filling was achieved by using shielded baskets.

The invention claimed is:

1. Anode assembly for electroplating comprising a) an anode body comprising soluble anode material and b) a shielding covering at least part of the anode body and comprising a self-passivating metal electrically connected to the anode body and allowing electrolyte transport therethrough, wherein:

(i) the shielding comprises at least one layer of self-passivating metal having no openings larger than 2 mm in width, or (ii) the shielding comprises at least two layers of self-passivating metal wherein the openings of at least one layer are at least partially covered by the metal of another layer.

2. Anode assembly according to claim 1, wherein the soluble anode material is selected from the group consisting of zinc, silver, tin, copper, nickel, cadmium, iron, cobalt, mixtures and alloys thereof.

3. Anode assembly according to claim 1, wherein the self-passivating metal is selected from the group consisting of titanium, zirconium, niobium, mixtures and alloys thereof.

4. Anode assembly according to claim 1, wherein the self-passivating metal is electrochemically oxidized on its surface.

5. Anode assembly according to claim 1, wherein the self-passivating metal is in the form of a net, mesh, grit, tissue or perforated sheet.

6. Anode assembly according to claim 1, wherein at least one layer of self-passivating metal has no openings larger than 0.5 mm in width.

7. Anode assembly according to claim 1, wherein the shielding of (ii) comprises at least two layers of self-passivating metal and the at least two layers of self-passivating metal have no openings larger than 10 mm in width.

8. Anode assembly according to claim 1, wherein the shielding of (ii) comprises at least three layers of self-passivating metal and the at least three layers of self-passivating metal have no openings larger than 20 mm in width.

9. Anode assembly according to claim 1, wherein the shielding of (ii) comprises at least four layers of self-passivating metal and the at least four layers of self-passivating metal have no openings larger than 30 mm in width.

10. Anode assembly according to claim 1, wherein the shielding has a total thickness of at least 1 mm.

11. Anode assembly according to claim 1, wherein the shielding comprises at least one layer of a non-metal material.

12. Anode assembly according to claim 11, wherein the non-metal material is a membrane.

13. Anode assembly according to claim 1, wherein the shielding covers all side and bottom portions of the anode body.

14. Anode assembly according to claim 1, wherein the anode body is in the form of a sheet, bar, plate, tube or rod.

15. Anode assembly according to claim 1, comprising a plurality of anode bodies arranged in a straight, curved or circular row and at least one shielding covering the side of the anode bodies facing the cathode, wherein the shielding covers one or more anode bodies.

16. Anode assembly according to claim 15, wherein the shielding also covers the side of the anode bodies which is turned away from the cathode.

17. Anode assembly according to claim 1, comprising an anode basket for holding particles of the soluble anode material.

18. Anode assembly according to claim 17, wherein the anode basket comprises a self-passivating metal.

19. Anode assembly according to claim 18, wherein the self-passivating metal is selected from the group consisting of titanium, zirconium, niobium, mixtures and alloys thereof.

20. Anode assembly according to claim 17, wherein the anode basket comprises a plastic material.

21. Anode assembly according to claim 17, wherein an insoluble active material or an activated corrosion-resistant metal is welded to the inside of the anode basket.

22. Anode assembly according to claim 17, wherein the shielding forms at least part of the anode basket.

23. Anode assembly according to claim 17, wherein the shielding covers only those portions of the anode basket that allow electrolyte transport there-through.

24. Anode assembly according to claim 1, wherein the shielding comprises at least one layer of self-passivating metal having no openings larger than 1 mm in width.

25. Shielded anode basket comprising a) an anode basket for holding particles of soluble anode material and b) a shielding comprising a self-passivating metal and allowing electrolyte transport therethrough, wherein:

(i) the shielding comprises at least one layer of self-passivating metal having no openings larger than 2 mm in width, or (ii) the shielding comprises at least two layers of self-passivating metal wherein the openings of at least one layer are at least partially covered by the metal of another layer.

26. Shielded anode basket according to claim 25 wherein the anode basket comprises sidewalls, a bottom wall and an open upper end and wherein at least one of the sidewalls allows electrolyte transport therethrough.

27. Shielded anode basket according to claim 25, wherein the self-passivating metal is selected from the group consisting of titanium, zirconium, niobium, mixtures and alloys thereof.

28. Shielded anode basket according to claim 25, wherein the self-passivating metal is electrochemically oxidized on its surface.

29. Shielded anode basket according to claim 25, wherein the self-passivating metal is in the form of a net, mesh, grit, tissue or perforated sheet.

30. Shielded anode basket according to claim 25, wherein at least one layer of self-passivating metal has no openings larger than 0.5 mm.

31. Shielded anode basket according to claim 25, wherein the shielding of (ii) comprises at least two layers of self-passivating metal and the at least two layers of self-passivating metal have no openings larger than 10 mm in width.

32. Shielded anode basket according to claim 25, wherein the shielding of (ii) comprises at least three layers of self-passivating metal and the at least three layers of self-passivating metal have no openings larger than 20 mm width.

33. Shielded anode basket according to claim 25, wherein the shielding of (ii) comprises at least four layers of self-passivating metal and the at least four layers of self-passivating metal have no openings larger than 30 mm in width.

34. Shielded anode basket according to claim 25, wherein the shielding comprises at least one layer of a non-metal material.

35. Shielded anode basket according to claim 34, wherein the non-metal material is a membrane.

36. Method of electroplating comprising using the anode assembly according to claim 1 or the shielded anode basket according to claim 25.

37. Shielded anode basket according to claim 25, wherein the shielding comprises at least one layer of self-passivating metal having no openings larger than 1 mm in width.

* * * * *